US009325083B2

(12) United States Patent
Miyamoto et al.

(10) Patent No.: US 9,325,083 B2
(45) Date of Patent: Apr. 26, 2016

(54) ELECTRIC WIRE WITH TERMINAL AND MANUFACTURING METHOD THEREOF

(75) Inventors: Kenji Miyamoto, Mie (JP); Toshiya Oota, Mie (JP); Junichi Ono, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 118 days.

(21) Appl. No.: 14/119,360

(22) PCT Filed: Jul. 2, 2012

(86) PCT No.: PCT/JP2012/066853

§ 371 (c)(1),
(2), (4) Date: Nov. 21, 2013

(87) PCT Pub. No.: WO2013/015076

PCT Pub. Date: Jan. 31, 2013

(65) Prior Publication Data

US 2014/0102785 A1 Apr. 17, 2014

(30) Foreign Application Priority Data

Jul. 26, 2011 (JP) ..... 2011-162968
Mar. 27, 2012 (JP) ..... 2012-070743

(51) Int. Cl.

| | |
|---|---|
| ***H01R 4/20*** | (2006.01) |
| ***H01R 4/18*** | (2006.01) |
| ***H01R 43/048*** | (2006.01) |
| *H01R 4/62* | (2006.01) |

(52) U.S. Cl.
CPC .. *H01R 4/18* (2013.01); *H01R 4/20* (2013.01); *H01R 43/048* (2013.01); *H01R 4/62* (2013.01); *Y10T 29/49183* (2015.01)

(58) Field of Classification Search
CPC ..... H01R 4/20; H01R 4/184
USPC ..... 174/84 C, 94 R
See application file for complete search history.

(56) References Cited

U.S. PATENT DOCUMENTS 3,955,044 A * 5/1976 Hoffman et al. ..... 174/84 C
5,109,147 A * 4/1992 Erlach ..... 219/85.16

(Continued)

FOREIGN PATENT DOCUMENTS

JP 2-90486 3/1990
JP 5-72053 9/1993

(Continued)

OTHER PUBLICATIONS

International Search Report, mail date is Aug. 14, 2012.

*Primary Examiner* — Chau N Nguyen
(74) *Attorney, Agent, or Firm* — Greenblum & Bernstein, P.L.C.

(57) ABSTRACT

An electric wire with a terminal includes an electric wire that has a conductor made of aluminum or aluminum alloy and an insulating coating covering the conductor, and a terminal that has a connecting portion to which an exposed conductor that is exposed at a terminal end of the electric wire is connected. The connecting portion is formed by compressing while heating a tubular part in a state in which the exposed conductor is inserted into the tubular part, the tubular part being provided on the terminal and being capable of allowing the exposed conductor to be inserted thereinto.

9 Claims, 14 Drawing Sheets

(56) References Cited

U.S. PATENT DOCUMENTS

| | | | | |
|---|---|---|---|---|
| 5,660,742 | A * | 8/1997 | Warner et al. | 219/85.16 |
| 6,011,233 | A * | 1/2000 | Hwang et al. | 219/91.21 |
| 6,676,458 | B2 * | 1/2004 | Kuwayama et al. | 439/877 |
| 7,374,466 | B2 * | 5/2008 | Onuma et al. | 439/874 |
| 2005/0026515 | A1 | 2/2005 | Hashimoto et al. | |
| 2006/0137893 | A1 * | 6/2006 | Sumi et al. | 174/84 R |
| 2009/0315419 | A1 * | 12/2009 | Mita et al. | 310/71 |

FOREIGN PATENT DOCUMENTS

| | | |
|---|---|---|
| JP | 2005-174896 | 6/2005 |
| JP | 2007-73491 | 3/2007 |
| JP | 2010-123449 | 6/2010 |

* cited by examiner

ELECTRIC WIRE WITH TERMINAL AND MANUFACTURING METHOD THEREOF

FIELD OF THE INVENTION

The present invention relates to an electric wire with a terminal and a manufacturing method thereof.

BACKGROUND OF THE INVENTION

An electric wire with a terminal is disclosed, for example, in Patent Literature 1 that includes an electric wire in which a conductor is covered by an insulating coating and at a terminal end the conductor is exposed, and a terminal that connects to the terminal end of the electric wire. In the electric wire with the terminal disclosed in Patent Document 1, a wire barrel of the terminal is crimped onto and electrically connected to the conductor exposed at the terminal end of the electric wire.

RELATED ART

Patent Literature

[Patent Literature 1] Japanese Utility Model Laid-Open Publication No. HEI 5-72053.

SUMMARY OF THE INVENTION

Problems to be Solved by the Invention

In the electric wire with the terminal as described above, it is possible that, due to a creep phenomenon, the crimped barrel returns to a state before crimping so that a contact load between the barrel and the exposed conductor of the electric wire decreases, a connection state worsens, and connection resistance increases.

In particular, for an electric wire having a conductor made of aluminum (alloy), difference between coefficients of thermal expansion of the terminal and the electric wire is large. Therefore, there is a problem that the electric wire with the terminal is likely to be affected by the creep phenomenon and the connection state is likely to worsen.

The present invention is accomplished in view of the above-described problem. A purpose of the present invention is to provide an electric wire with a terminal having improved connection reliability between the electric wire and the terminal and a manufacturing method thereof.

Means for Solving the Problems

To achieve the above purpose, the present invention provides an electric wire with a terminal that includes an electric wire having a conductor made of aluminum or aluminum alloy and an insulating coating covering the conductor, and a terminal having a connecting portion to which an exposed conductor of the electric wire is connected, the exposed conductor being exposed at a terminal end of the electric wire. The connecting portion is formed by compressing while heating a tubular part in a state in which the exposed conductor is inserted into the tubular part, the tubular part being provided on the terminal and being capable of allowing the exposed conductor to be inserted thereinto.

Further, the present invention provides a manufacturing method for an electric wire with a terminal. The electric wire with a terminal includes an electric wire and a terminal, the electric wire having a conductor and an insulating coating covering the conductor, the conductor being made of aluminum or aluminum alloy, the terminal having a connecting portion to which an exposed conductor of the electric wire is connected, the exposed conductor being exposed at a terminal end of the electric wire. The manufacturing method includes inserting the exposed conductor into a tubular part, the tubular part being provided on the terminal and being capable of allowing the exposed conductor to be inserted thereinto; and, thereafter, forming the connecting portion by compressing while heating the tubular part.

In the present invention, the connecting portion of the terminal that connects with the electric wire is formed by compressing while heating the tubular part provided on the terminal in the state in which the exposed conductor is inserted into the tubular part. Therefore, in the present invention, the tubular part of the terminal is compressed in the state of being softened by heating. Therefore, a ratio of a cross-sectional area after compression with respect to a cross-sectional area before compression can be reduced more than that of compression without heating. As a result, according to the present invention, by putting the connecting portion in a state of high compression, a contact area between the terminal and the exposed conductor is increased and destruction of an oxide film of the exposed conductor is facilitated. Therefore, the connection reliability can be improved.

It is preferable that the present invention adopts the following configurations. The connecting portion has a cross-sectional area of 30% or more and 70% or less with respect to a cross-sectional area of a portion corresponding to the connecting portion before compression. With this configuration, a contact area between the exposed conductor and the terminal can be increased and, in addition, breakage of the conductor due to high compression is also unlikely to occur.

The connecting portion is formed by compressing while heating the tubular part at a temperature of 300° C. or more and 500° C. or less. When a heating temperature of the tubular part is too high, problems may arise such as that the insulating coating of the electric wire may be damaged, that the terminal may be deformed, and that the conductor may be melted and thinned. Therefore, with the above configuration, the tubular part of the terminal can be heated and softened at a temperature lower than a melting point of aluminum that is a material of the conductor. Thus, the conductor is not thinned, the oxide film of the conductor is easily destroyed, and the connection reliability can be further improved.

The tubular part is compressed using a compression mold while being electrically heated. With this configuration, the connecting portion can be formed using a method superior in thermal efficiency.

The connecting portion is formed by compressing using a compression mold that has electrode parts corresponding to an outer peripheral shape of the tubular part before compression. The compression mold may have electrode parts corresponding to an outer peripheral shape of the tubular part before compression. With this configuration, a contact area between the compression mold and the tubular part is increased. Therefore, the tubular part can be efficiently thermally compressed and deformation of the terminal can also be reduced.

Effect of the Invention

According to the present invention, an electric wire with a terminal having improved connection reliability between the electric wire and the terminal and a manufacturing method thereof can be provided.

MODE FOR CARRYING OUT THE INVENTION

First Embodiment

Figure 1:
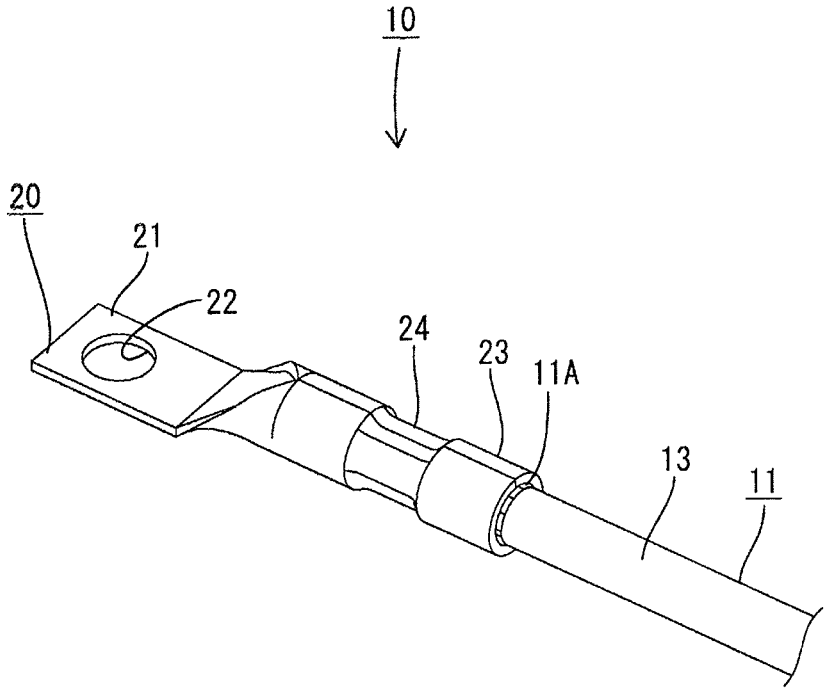
FIG. 1 illustrates a perspective view of an electric wire with a terminal according to a first embodiment.
Figure 2:
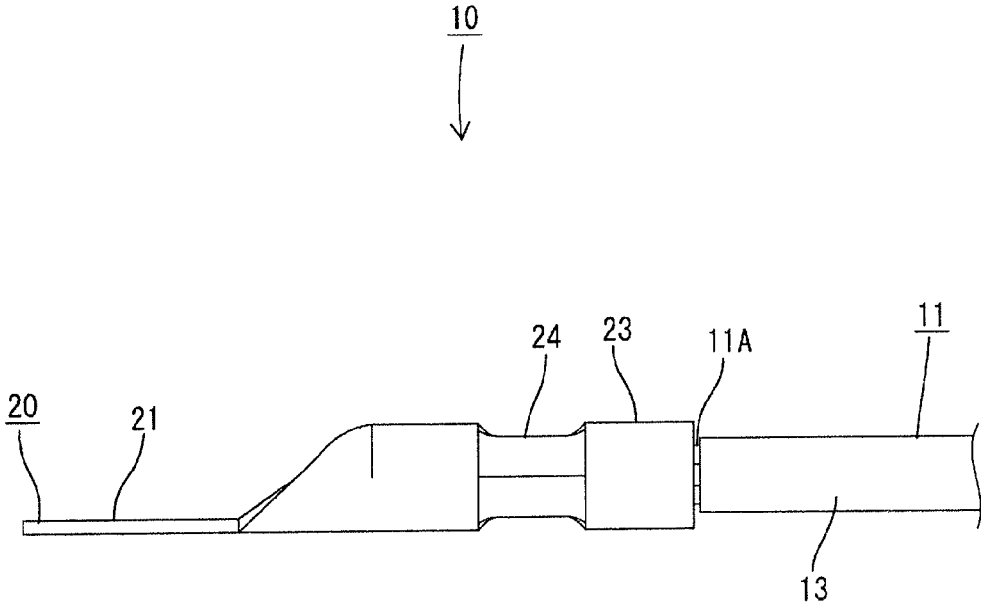
FIG. 2 illustrates a side view of the electric wire with the terminal.

An electric wire with a terminal 10 according to a first embodiment of the present invention is described with reference to FIGS. 1-7. As illustrated in FIG. 1, the electric wire with the terminal 10 of the first embodiment includes an electric wire 11, and a terminal 20 connected to a terminal end 11A of the electric wire 11. In the following description, an up-down direction is defined based on FIG. 2, and as for a front-rear direction, a leftward direction in FIG. 2 is a forward direction and a rightward direction in FIG. 2 is a rearward direction.

Figure 3:
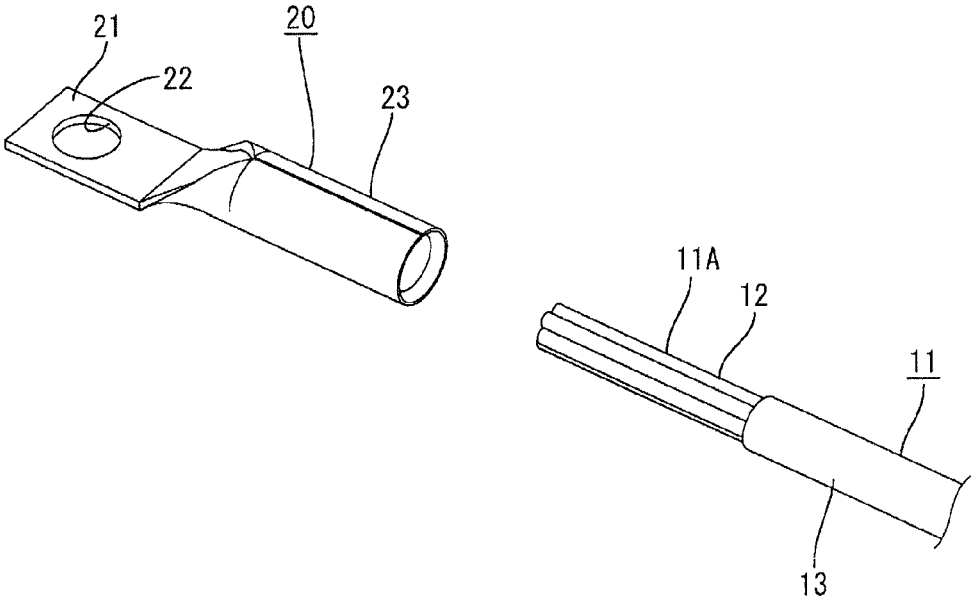
FIG. 3 illustrates an explanatory diagram describing a procedure for inserting an electric wire into a terminal.

As illustrated in FIG. 1, in the electric wire 11, an insulating coating 13 covers around a conductor 12. As illustrated in FIG. 3, at the terminal end 11A of the electric wire, the insulating coating 13 is removed and the conductor 12 is exposed (corresponding to an "exposed conductor 12"). The conductor 12 is a stranded wire in which a plurality of metal element wires are twisted together. The conductor 12 (metal element wires) is made of aluminum or aluminum alloy.

The electric wire 11 has circular cross section. However, a portion of the exposed conductor 12 of a portion of the terminal end 11A that is connected to the terminal 20 is deformed by thermally compressing to have a hexagonal cross section.

The terminal 20 has a flat plate-shaped terminal connecting portion 21 that is connected to a counterpart terminal (not illustrated in the drawings), and a tubular wire connecting portion 23 that extends rearward from the terminal connecting portion 21 and to which the electric wire 11 is connected. A terminal connecting hole 22 connecting the counterpart terminal is provided at a substantially central portion of the terminal connecting portion 21.

The wire connecting portion 23 has a tubular shape capable of allowing the conductor 12 of the electric wire 11 to be inserted therein (an example of a tubular part 23). In the present embodiment, the wire connecting portion 23 is formed by deforming, into a tubular shape, a portion that extends rearward from the flat plate-shaped terminal connecting portion 21.

As illustrated in FIG. 2, a substantially central portion of the wire connecting portion 23 in a longitudinal direction is more compressed than other portions. Although the wire connecting portion 23 is in contact with the conductor 12 in all portions, a contact area between the wire connecting portion 23 and the conductor 12 is increased particularly at a compressed portion 24 of the substantially central portion. The compressed portion 24 corresponds to a connecting portion 24 in the present invention. The connecting portion 24 is compressed to have a cross-sectional area (an area of a cross section cut in a direction perpendicular to the longitudinal direction) of 30% or more and 70% or less of a cross-sectional area of a portion 25 that corresponds to the connecting portion 24 before compression, and has a cross section of a hexagonal shape.

Metallic materials that can be used to configure the terminal 20 include, for example, copper, copper alloy, aluminum, aluminum alloy, and the like, and can be selected as appropriate from any metallic materials as needed. A plating layer is formed on a surface of a metal plate that configures the terminal 20 of the present embodiment. Metals that can be used to configure the plating layer include, for example, tin, nickel, and the like, and can be selected as appropriate from any metallic materials as needed.

Figure 4:
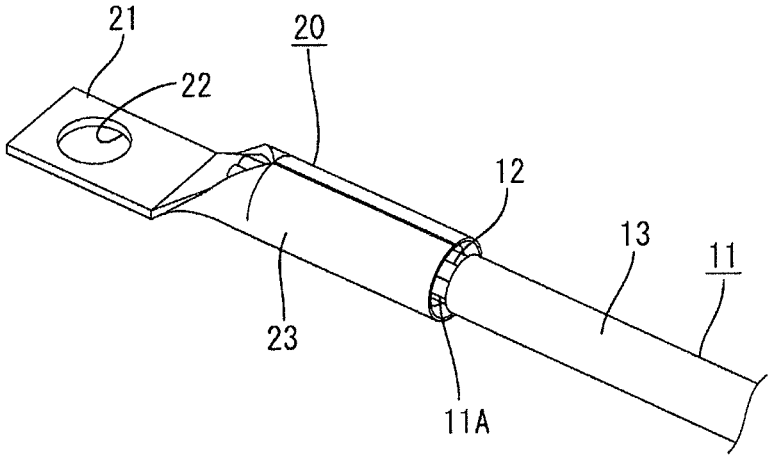
FIG. 4 illustrates a perspective view of the terminal in a state in which the electric wire is inserted into the terminal (before compression).

Next, a manufacturing method of the electric wire with the terminal 10 of the present embodiment is described. The terminal 20 of a shape illustrated in FIG. 3 is provided. The insulating coating 13 of the terminal end 11A of the electric wire 11 is removed to expose the conductor 12. Next, as illustrated in FIG. 4, the conductor 12 (exposed conductor 12) that is exposed at the terminal end 11A of the electric wire 11 is inserted into the tubular part 23 of the terminal 20.

Figure 5:
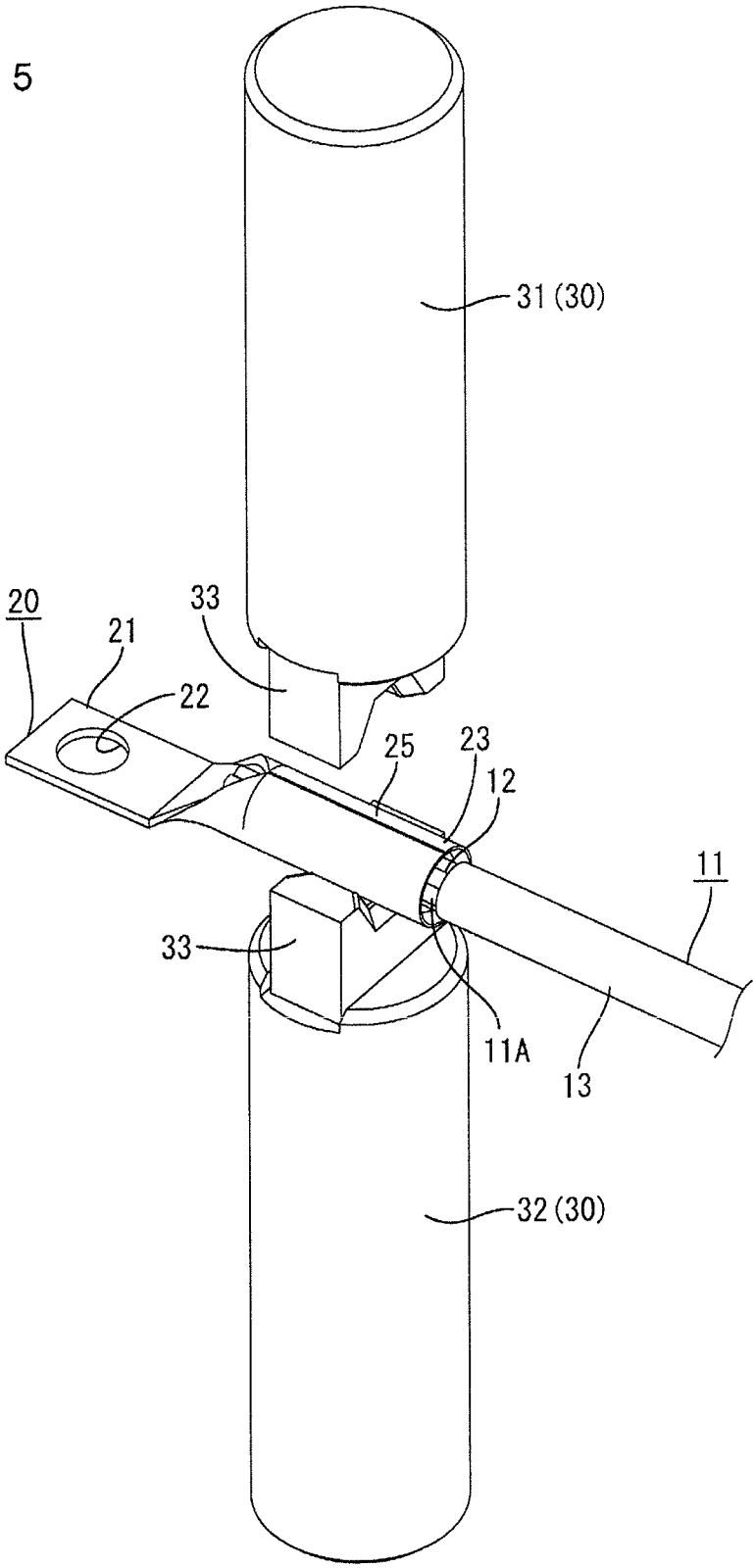
FIG. 5 illustrates a perspective view describing a procedure for arranging the terminal of FIG. 4 in a compression mold.
Figure 6:
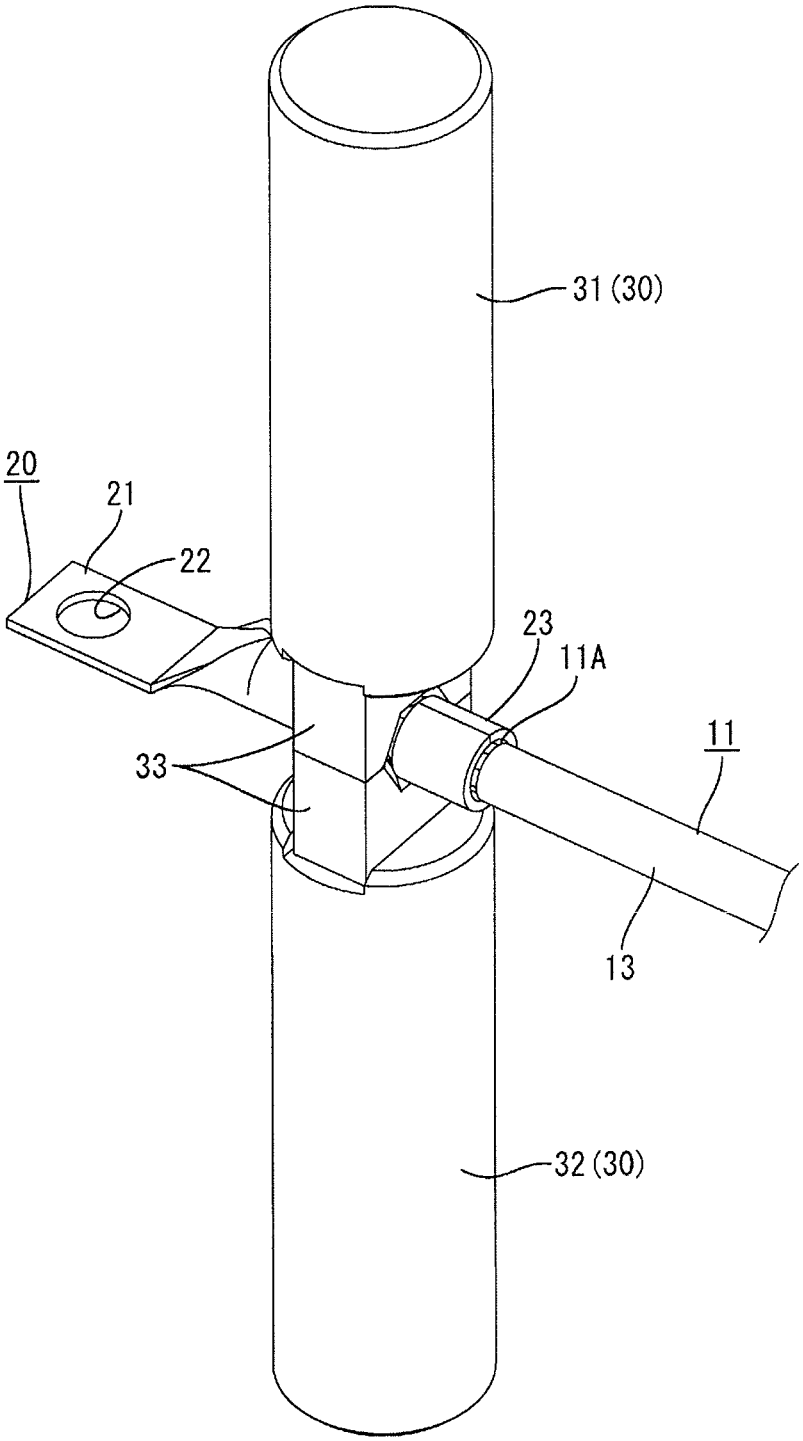
FIG. 6 illustrates a perspective view describing a state in which the terminal of FIG. 4 is sandwiched by the compression mold.
Figure 7:
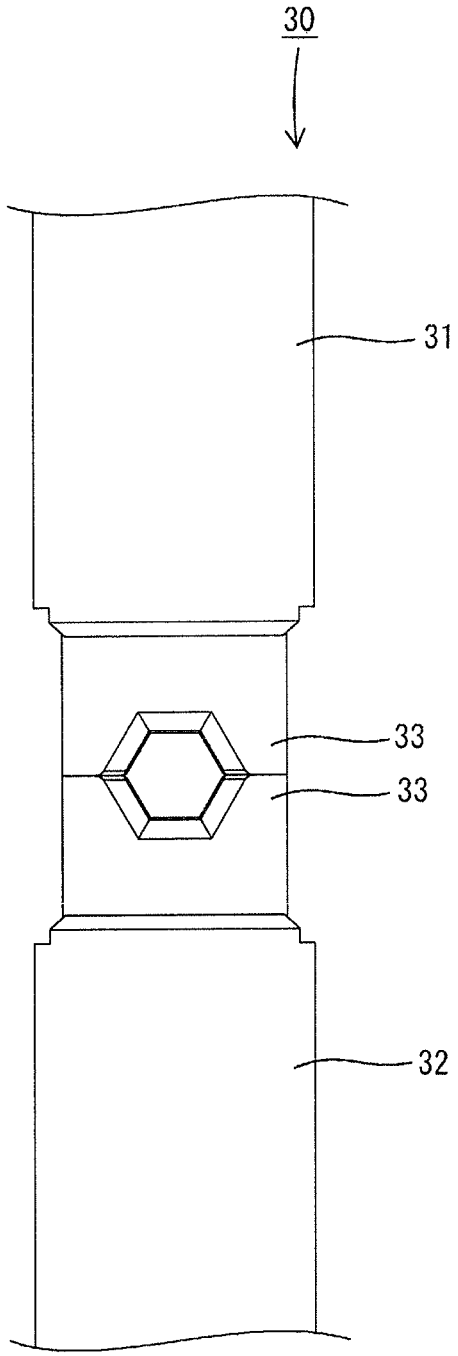
FIG. 7 illustrates a front view of the compression mold.

The tubular part 23 of the terminal 20, into which the exposed conductor 12 of the electric wire 11 is inserted, is thermally compressed using a compression mold illustrated in FIGS. 5-7. During the thermal compression, the tubular part 23 of the terminal 20 is in a state of being sandwiched between a compression mold 32 arranged on a lower side and a compression mold 31 arranged on an upper side (see FIGS. 5 and 6). After a state illustrated in FIG. 6 is achieved, a current is applied to an energizing part 33 of the compression mold 30 to compress the tubular part 23 while the tubular part 23 is electrically heated.

By compressing while electrically heating the tubular part 23 of the terminal 20, into which the exposed conductor 12 of the electric wire 11 is inserted, a portion of the tubular part 23 of the terminal 20 is compressed and the connecting portion 24 having a hexagonal cross section is formed, and the electric wire with the terminal 10 illustrated in FIG. 1 is obtained.

Here, when a heating temperature during the electrical heating of the tubular part 23 is too high, problems may arise such as that the insulating coating 13 of the electric wire 11 may be damaged, that the terminal 20 may be deformed, and that the conductor 12 may be melted and thinned. Therefore, in the present embodiment, the temperature during the electrical heating (temperature measured using a radiation thermometer) is 300° C. or more and 500° C. or less. When the heating temperature is set in this range, the tubular part 23 can be heated and softened at a temperature lower than a melting point of aluminum that is the material of the conductor 12. Therefore, the conductor 12 is not thinned and, in addition, an oxide film of the conductor 12 of the electric wire 11 is easily destroyed. It is particularly preferable that the heating temperature is 400° C. or less.

It is preferable that a compression force during the compression of the tubular part 23 is set in a range of 980 N (100 kgf)-1960 N (200 kgf).

In the present embodiment, a compression ratio of the connecting portion 24 (ratio of a cross-sectional area after compression with respect to a cross-sectional area before compression) is set in a range of 30% or more and 70% or less. When the compression ratio is set in this range, a contact area between the exposed conductor 12 and the terminal 20 can be increased and, in addition, breakage of the conductor 12 due to high compression is also unlikely to occur. When the compression ratio is less than 30%, the breakage of the conductor 12 may occur. When the tubular part 23 is compressed without heating, the compression ratio has an upper limit of approximately 90%. When the tubular part 23 is compressed without heating and the compression ratio is less than 90%, a problem may arise such as that cracks may form in the terminal 20. However, when the compression is performed while the tubular part 23 of the terminal 20 is softened by the electrical heating as in the present embodiment, the problem of cracks does not arise and thus a compression ratio of 70% or less can be achieved.

Next, effects of the present embodiment are described. In the present embodiment, the tubular part 23 of the terminal 20 is compressed in the state of being softened by heating. Therefore, the ratio of the cross-sectional area after compression with respect to the cross-sectional area before compression can be reduced more than that of compression without heating. As a result, according to the present embodiment, the connecting portion 24 can be put in a state of high compression; the contact area between the terminal 20 and the exposed conductor 12 is increased; and destruction of the oxide film of the exposed conductor 12 is facilitated. Therefore, connection reliability can be improved.

Further, according to the present embodiment, the connecting portion 24 is compressed to have a cross-sectional area of 30% or more and 70% or less of the cross-sectional area of the portion 25 that corresponds to the connecting portion 24 before compression. Therefore, the contact area between the exposed conductor 12 and the terminal 20 can be increased and, in addition, breakage of the conductor 12 due to high compression is also unlikely to occur.

Further, according to the present embodiment, the connecting portion 24 is formed by compressing while heating the tubular part 23 to a temperature of 300° C. or more and 500° C. or less and thus the tubular part 23 of the terminal 20 can be heated and softened at a temperature lower than the melting point of aluminum which is the material of the conductor 12. Therefore, the conductor 12 is not thinned and, in addition, the oxide film of the conductor 12 is easily destroyed and the connection reliability can be further improved.

Further, according to the present embodiment, the tubular part 23 is compressed using the compression mold while being electrically heated. Therefore, the connecting portion 24 can be formed using a method superior in thermal efficiency.

Second Embodiment

An electric wire with a terminal 50 according to a second embodiment of the present invention is described with reference to FIGS. 9-17. In the following description, an up-down direction is defined based on FIGS. 10 and 15, and as for a front-rear direction, a leftward direction in FIG. 10 is a forward direction and a rightward direction in FIG. 10 is a rearward direction. A configuration that is the same as in the first embodiment is indicated using the same reference numeral as in the first embodiment and overlapping description is omitted.

Figure 15:
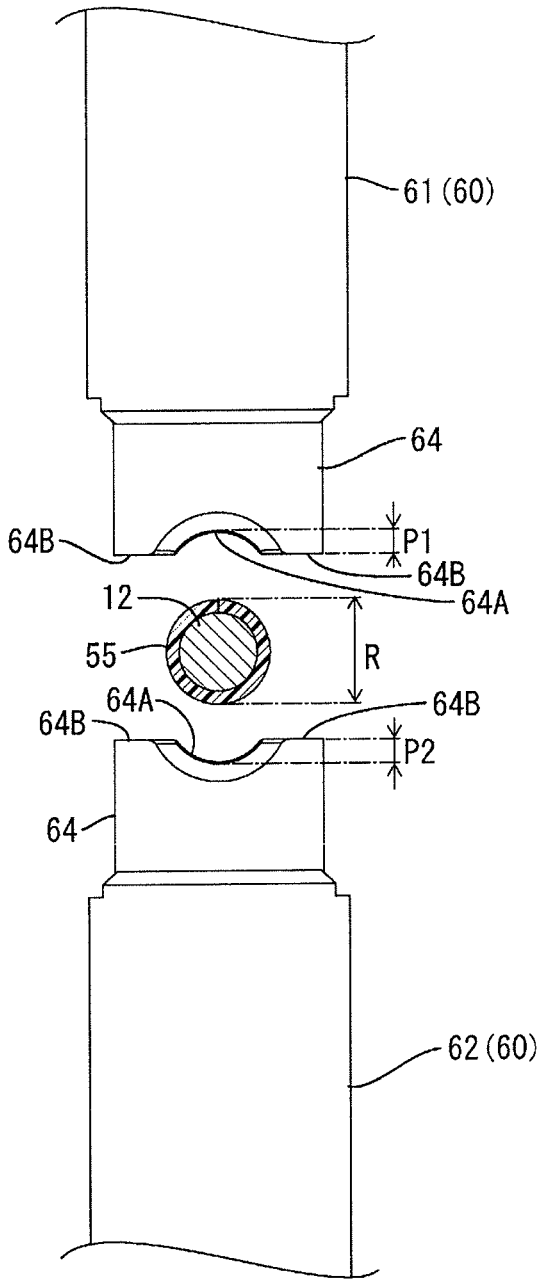
FIG. 15 illustrates a partial cross-sectional view of the state illustrated in FIG. 14.
Figure 16:
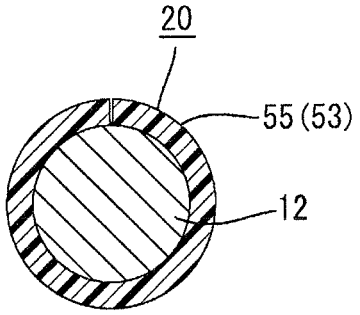
FIG. 16 illustrates a cross-sectional view of a portion corresponding to the connecting portion before compression in the plane perpendicular to the longitudinal direction.
Figure 17:
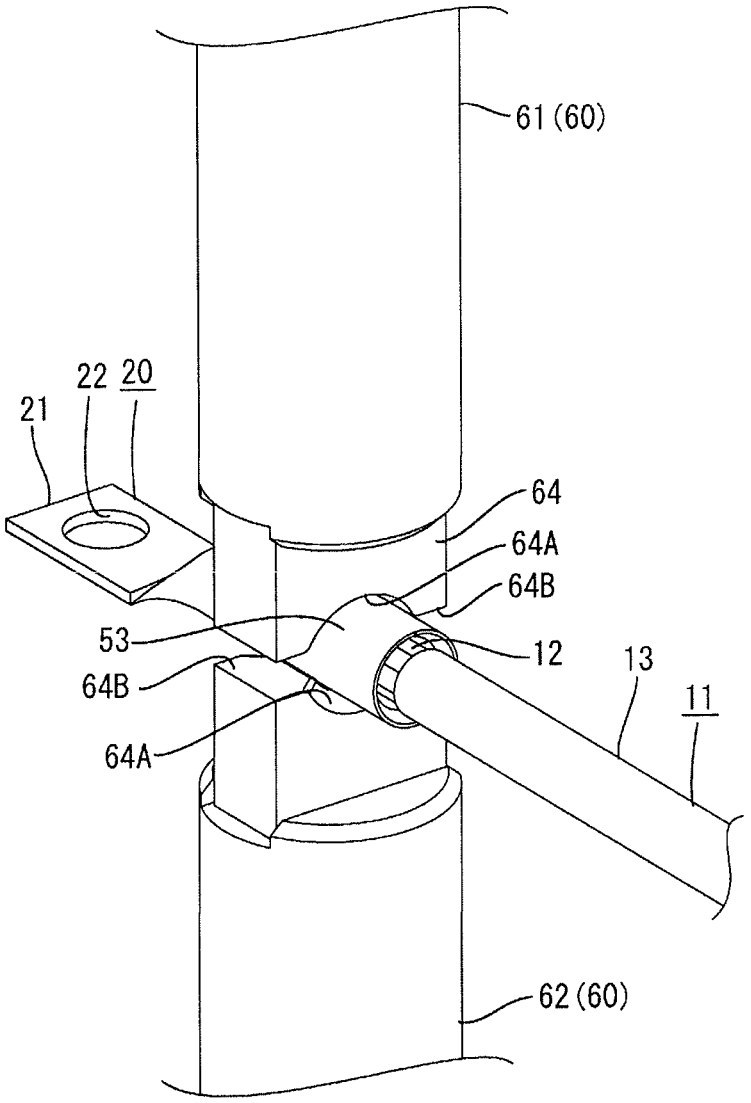
FIG. 17 illustrates a perspective view describing a procedure for arranging the terminal with the electric wire inserted therein in the compression mold.

An electric wire with a terminal 50 of the present embodiment is different from the first embodiment in that the electric wire with the terminal 50 is provided with a connecting portion 54 formed by compressing using a compression mold 60 that has, as illustrated in FIG. 15, energizing parts 64 (electrode parts 64) corresponding to an outer peripheral shape of a tubular part 53 before compression.

Figure 9:
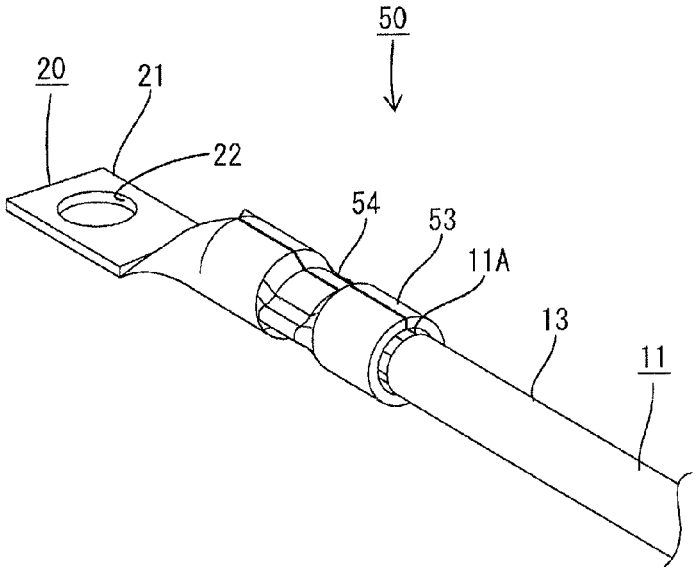
FIG. 9 illustrates a perspective view of an electric wire with a terminal according to a second embodiment.
Figure 10:
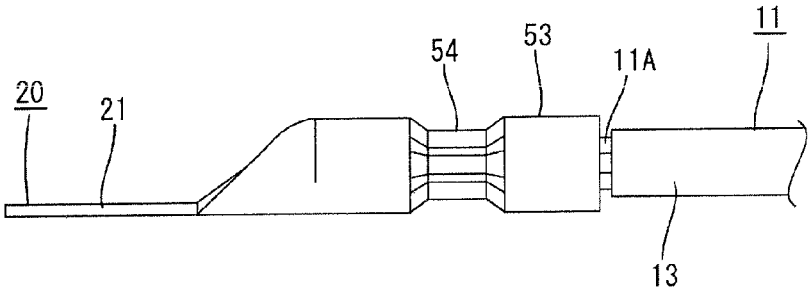
FIG. 10 illustrates a side view of the electric wire with the terminal.
Figure 11:
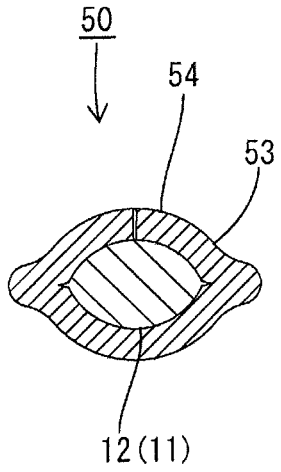
FIG. 11 illustrates a cross-sectional view of a connecting portion in a plane perpendicular to a longitudinal direction.

As illustrated in FIGS. 9-11, the electric wire with the terminal 50 of the present embodiment is compressed along the electrode part 64 and has the connecting portion 54 that has a substantially oval-shaped cross section (cross section in a direction perpendicular to the longitudinal direction).

Figure 12:
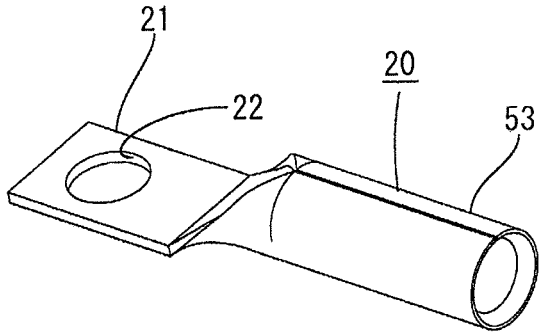
FIG. 12 illustrates a perspective view of the terminal.
Figure 13:
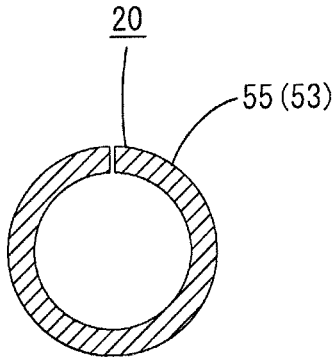
FIG. 13 illustrates a cross-sectional view of the terminal in the plane perpendicular to the longitudinal direction.

As illustrated in FIG. 12, the terminal 20 of the electric wire with the terminal 50 has the same configuration as the first embodiment. A portion 55 corresponding to the connecting portion before the terminal 20 is compressed has an annular shape as illustrated in FIG. 13.

Next, a manufacturing method of the electric wire with the terminal 50 of the present embodiment is described. The terminal 20 of a shape illustrated in FIG. 12 is provided. The insulating coating 13 of the terminal end 11A of the electric wire 11 is removed to expose the conductor 12. Next, as illustrated in FIG. 14, the conductor 12 (exposed conductor 12) that is exposed at the terminal end 11A of the electric wire 11 is inserted into the tubular part 53 of the terminal 20.

Figure 14:
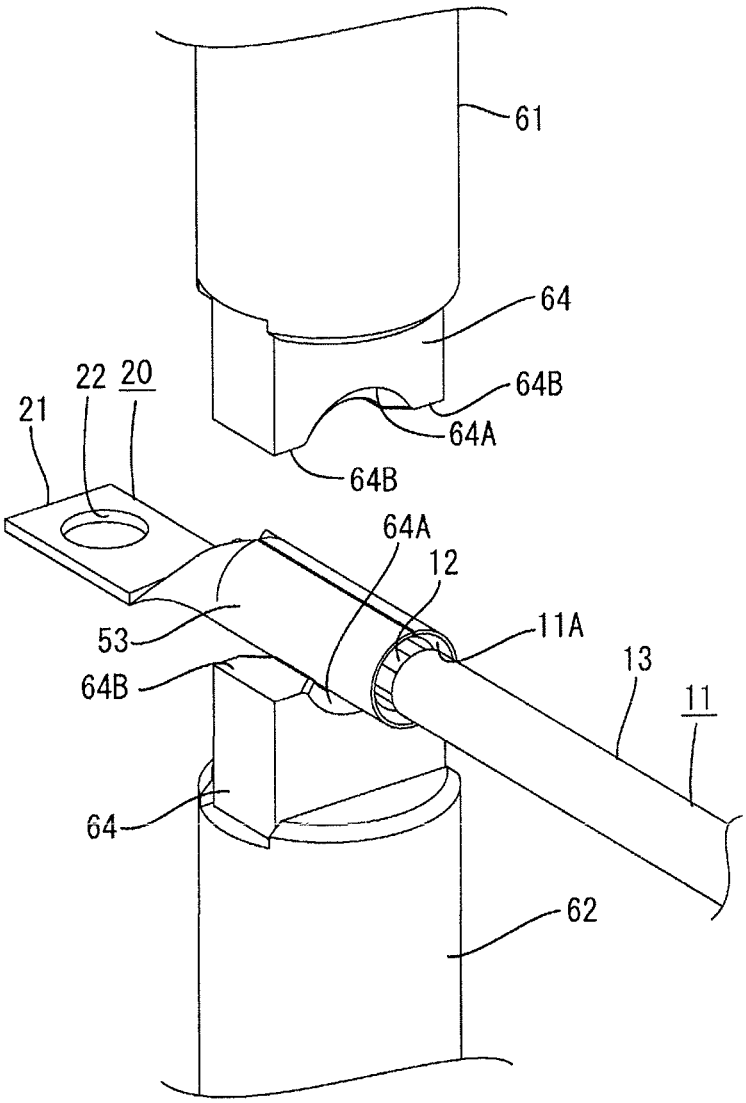
FIG. 14 illustrates a perspective view describing a state in which the terminal with the electric wire inserted therein is arranged in a compression mold.

The tubular part 53 of the terminal 20, into which the exposed conductor 12 of the electric wire 11 is inserted, is thermally compressed using the compression mold 60 illustrated in FIGS. 14 and 15. During the thermal compression, the tubular part 53 of the terminal 20 is in a state of being sandwiched between the electrode part 64 of a compression mold 62 arranged on a lower side and the electrode part 64 of a compression mold 61 arranged on an upper side (see FIGS. 17 and 18).

As illustrated in FIG. 15, the electrode part 64 of the compression mold 60 used in the present embodiment has a recessed portion 64A formed along the outer peripheral shape of the tubular part 53 of the terminal 20 and a flat surface 64B formed on both sides of the recessed portion 64A. In the present embodiment, a sum of a recess depth P1 of the recessed portion 64A of the electrode part 64 of the compression mold 61 and a recess depth P2 of the recessed portion 64A of the electrode part 64 of the compression mold 62 is configured to be smaller than a thickness dimension R of the tubular part 53 before compression (see FIG. 15).

Figure 18:
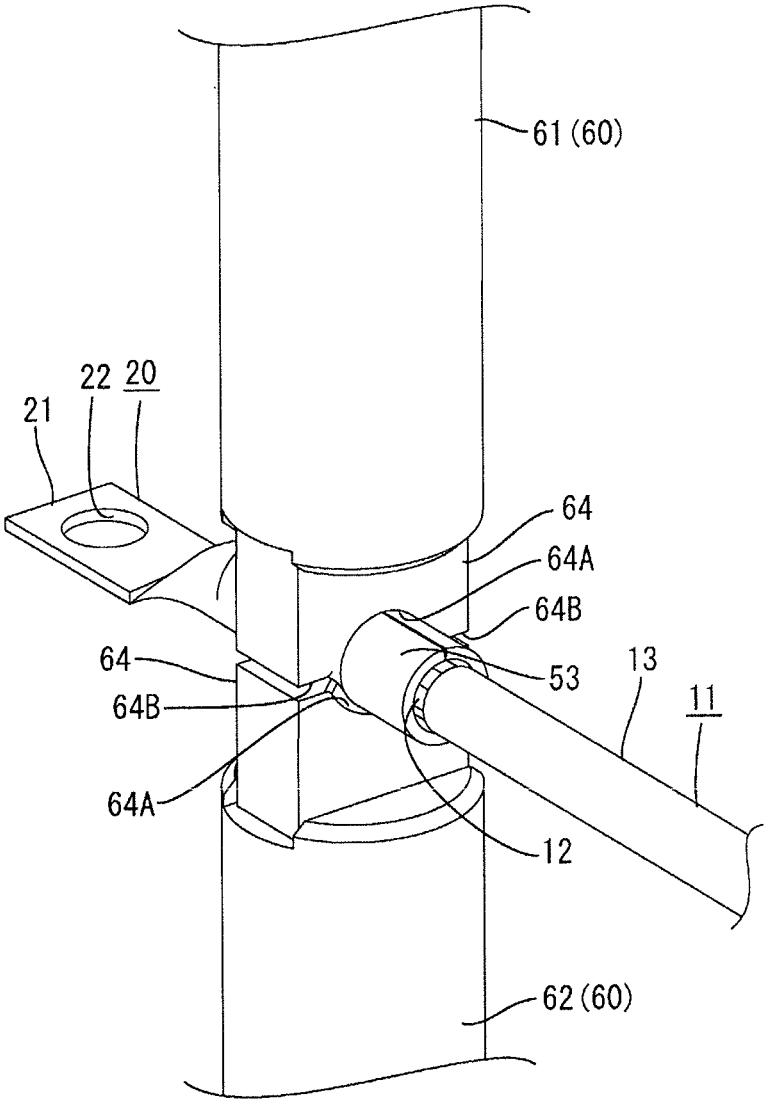
FIG. 18 illustrates a perspective view describing a state in which the terminal with the electric wire inserted therein is sandwiched by the compression mold.

After the electrode part 64 of the compression mold 61 on an upper side and the electrode part 64 of the compression mold 61 on a lower side are brought to a state illustrated in FIG. 18, a current is applied to the electrode parts 64 of the compression mold 60 to compress the tubular part 53 while the tubular part 53 is electrically heated. In this state, entire areas of the recessed portions 64A, 64A of the electrode parts 64, 64 arranged on the upper and lower sides are respectively in contact with outer peripheral portions of the tubular part 53 and the applied current flows through the contact portions. By applying a current to the electrode parts 64, the tubular part 53 is compressed, and the flat surfaces 64B, 64B of the electrode parts 64 arranged on the upper and lower sides are in a state of being in contact with each other. Preferred ranges of a temperature (measured using a radiation thermometer), a compression force and a compression ratio during the electrical heating are the same as in the first embodiment.

When the thermal compression work of the tubular part 53 of the terminal 20 is completed, a portion of the tubular part 53 of the terminal 20 is compressed and the connecting portion 54 having a substantially oval cross-sectional shape as illustrated in FIG. 11 is formed and the electric wire with the terminal 50 illustrated in FIG. 9 is obtained. Configurations other than the compression mold 60 used to prepare the connecting portion 54 and the shape of the connecting portion 54 are substantially the same as those of the first embodiment.

The present embodiment has the following effects in addition to the effects described in the first embodiment. According to the present embodiment, the connecting portion 54 is formed using the compression mold 60 that has the electrode parts 64 of a shape corresponding to the outer peripheral shape of the tubular part 53 before compression. Therefore, the contact area between the compression mold 60 and the tubular part 53 is increased, the tubular part 53 can be efficiently thermally compressed, and deformation of the terminal 20 can also be reduced.

Other Embodiments

The present invention is not limited to the above description and the embodiment described using the drawings. For example, embodiments such as the following are also included in the technical scope of the present invention.

Figure 8:
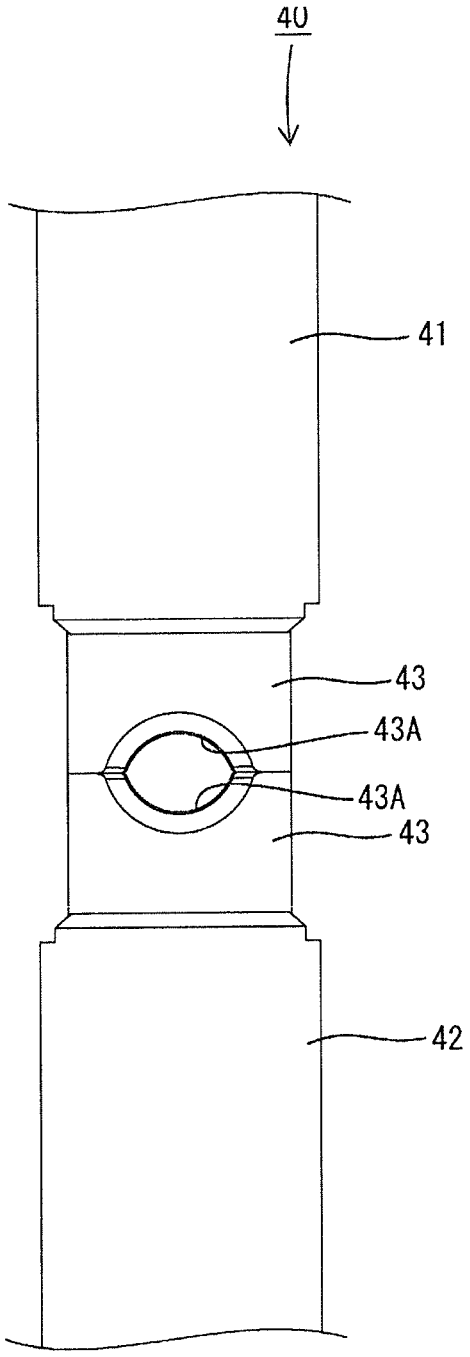
FIG. 8 illustrates a front view of a compression mold described in another embodiment.

(1) In the above second embodiment, the electric wire with the terminal 50 is described as having the connecting portion 54 prepared using the compression mold 60 that has the electrode parts 64 of a shape corresponding to the outer periphery of the tubular part 53 before compression. However, an electric wire with a terminal formed using a compression mold 40 as illustrated in FIG. 8 may also be used. A recessed portion 43A of an electrode part 43 (energizing part 43) of the compression mold does not have a shape corresponding to the outer peripheral shape of the tubular part before compression. However, a connecting portion having a substantially oval cross-sectional shape is formed by thermal compression.

Similar to the compression mold 30 illustrated in FIG. 7, the compression mold 40 illustrated in FIG. 8 includes a compression mold 41 on an upper side and a compression mold 42 on a lower side. Each of the compression molds 41, 42 has the electrode part 43.

(2) In the above embodiments, the connecting portion 24 is formed by compressing while electrically heating the tubular part 23. However, the tubular part 23 may also be compressed while being heated using a different heating method.

(3) In the above embodiments, the connecting portion 24 is described having a cross-sectional area of 30%-70% relative to the cross-sectional area of the portion 25 that corresponds to the connecting portion 24 before compression. However, the cross-sectional area of the connecting portion may also be 70% or more relative to the cross-sectional area before compression.

(4) In the above embodiments, the heating temperature of the tubular part 23 when the connecting portion 24 is formed is in the range of 300° C.-500° C. However, the heating temperature may also be lower than 300° C. or higher than 500° C.

DESCRIPTION OF REFERENCE NUMERALS

10, 50: electric wire with a terminal
11: electric wire
11 A: terminal end
12: conductor
13: insulating coating
20: terminal
21: terminal connecting portion
23, 53: wire connecting portion (tubular part)
24, 54: connecting portion (compressed portion)
25, 55: portion corresponding to connecting portion before compression
30, 40, 60: compression mold
31, 41, 61: compression mold on upper side
32, 42, 62: compression mold on lower side
33, 43, 64: energizing part (electrode part)
50: receiver

The invention claimed is:

1. An electrical connector, comprising:

an electric wire having a conductor made of one of aluminum and an aluminum alloy, and an insulating coating covering the conductor; and a terminal having a connecting portion that is compression heated and to which an exposed conductor of the electric wire is connected, the exposed conductor being exposed at a terminal end of the electric wire, wherein the connecting portion is formed by compressing while heating a tubular part of the terminal in a condition in which the exposed conductor is inserted into the tubular part and at a temperature between 300° C. and 500° C., and wherein a cross-sectional area of the connecting portion is 30% to 70% of a cross-sectional area of a portion corresponding to the connecting portion before the connecting portion is compression heated.

2. The electrical connector according to claim 1, wherein the connecting portion is formed by compressing using a compression mold including electrode parts corresponding to an outer peripheral shape of the tubular part before compression.

3. The electrical connector according to claim 1, wherein a shape of the cross-sectional area, resulting from the compression, is hexagonal.

4. The electrical connector according to claim 1, wherein a shape of the cross-sectional area, resulting from the compression, is oval.

5. A method of manufacturing an electrical connector, the method comprising:

providing an electric wire having a conductor and an insulating coating covering the conductor, the conductor being made of one of aluminum and an aluminum alloy, providing a terminal having a connecting portion to which an exposed conductor of the electric wire is connected, the exposed conductor being exposed at a terminal end of the electric wire, inserting the exposed conductor into a tubular part of the terminal; and, thereafter, forming the connecting portion by compressing while heating the tubular part at a temperature between 300° C. and 500° C., and wherein the connecting portion is formed by compressing the connecting portion to have a cross-sectional area of 30% to 70% of a cross-sectional area of a portion corresponding to the connecting portion before compression.

6. The method according to claim 5, wherein the tubular part is compressed using a compression mold while being electrically heated.

7. The method according to claim 6, wherein the compression mold has electrode parts corresponding to an outer peripheral shape of the tubular part before compression.

8. The method according to claim 5, wherein a shape of the cross-sectional area, resulting from the compression, is hexagonal.

9. method according to claim 5, wherein a shape of the cross-sectional area, resulting from the compression, is oval.

* * * * *